US005762113A

United States Patent [19]

Ricossa et al.

[11] Patent Number: 5,762,113

[45] Date of Patent: Jun. 9, 1998

[54] VOLUMETRIC CONTAINER FILLING APPARATUS

[75] Inventors: Philip Ricossa, Richmond, Mich.; Rhys D. Thompson, Menomonee Falls, Wis.

[73] Assignee: Voll Tech Inc., Port Huron, Mich.

[21] Appl. No.: 606,330

[22] Filed: Feb. 23, 1996

[51] Int. Cl.[6] ..... B65B 1/04

[52] U.S. Cl. ..... 141/78; 141/73; 141/148; 53/525

[58] Field of Search ..... 141/72, 73, 74, 141/78, 79, 80, 144, 145, 147, 148; 53/525, 437, 253

[56] References Cited

U.S. PATENT DOCUMENTS

| | | | |
|---|---|---|---|
| 1,266,706 | 5/1918 | Nickle | 141/72 |
| 1,778,216 | 10/1930 | Hansen | 141/145 |
| 1,828,167 | 10/1931 | Ayars | 141/144 |
| 2,360,198 | 10/1944 | Carter | 141/147 |
| 2,922,444 | 1/1960 | Minard | 141/145 |

OTHER PUBLICATIONS

Food Machinery Catalog, No. 184, Section 4 —Fillers/Closers, pp. 47–50 (no available date).

*Primary Examiner*—Henry J. Recla
*Assistant Examiner*—Steven O. Douglas
*Attorney, Agent, or Firm*—Varnum, Riddering, Schmidt & Howlett LLP

[57] ABSTRACT

Volumetric container filling apparatus comprises a revolving carousel including a product bowl provided with a plurality of openings, volume-defining tubular sections provided with sliding gates and pedestals for supporting containers to be filled. A tubular extension extends below each sliding gate. A vibrating cam imparts a vibration in a vertical direction to the pedestals and any container disposed on a pedestal. A container chuck engages an upper edge of a container on a pedestal. The container chuck and tubular extension together define an enclosed collection area for temporarily retaining product while the contents of the container is settled by the vertical vibration. The carousel further includes a vibrating outer cup in each opening of the product bowl to reduce bridging which tends to occur with low density product. Each outer cup is connected by means of vertically-extending rods to a corresponding container chuck. The rods transmit vibrations from a container on a vibrating pedestal to the associated inner cup. In this manner, vertically-directed vibrations are transmitted from a vibrating cam via pedestals to containers and via container chucks and interconnecting rods to associated outer cups, thereby aiding in the settling of product in a container from a collection area below the gate valve while a corresponding vibrating outer cup aids in the filling of the volume-defining area above the gate valve.

16 Claims, 5 Drawing Sheets

VOLUMETRIC CONTAINER FILLING APPARATUS

BACKGROUND OF THE INVENTION

1. Field of the Invention

The invention relates to apparatus for filling containers with measured quantities and more particularly to apparatus for filling containers employing vibratory devices.

2. Background Art

Standard volumetric fillers typically include a circular product bowl into which a product is deposited for filling containers. The bowl is provided with a lower wall having a plurality of openings. A support plate disposed below the product bowl is provided with a plurality of tubular sections extending a predefined distance below the bottom wall of the product bowl and defining a volume of product to be deposited in a container. The product bowl and the plate supporting the volume-defining tubular sections are typically mounted on a common shaft and rotated. A support plate for supporting containers is disposed below the other plates and rotated on the same central shaft. Empty containers are typically deposited from a conveyor onto the container support plate in alignment with the volume-defining tubular sections and filled containers are removed in a similar fashion. The volume-defining tubular sections are filled as the product bowl is rotated on the shaft and the sliding gates are opened in sequence and coordinated with the deposit of an empty container on the container support plate.

Generally, all of the product contained in the volume-defining tubular section will have settled in the container before the container is removed. However, there are a number of products, typically low density products, such as french style green beans, bacon bits, spices, and other products which present filling difficulties. Some of these products, such as spices, are typically contained in small volume containers. If the container is not properly filled, the desired weight for each container is not achieved and a portion of the product will spill over, resulting in improperly filled containers and a loss of product. Furthermore, the spilled product must be periodically removed adding to the expense of the filling operation.

One problem which tends to occur with low density product which does not flow freely is that the volume-defining tubular sections are not properly filled due to a phenomenon known as "bridging." This occurs when a wall or dam of the product is formed by the product preventing the free flow of the product in the volume-defining tubular sections. As a result, containers are not properly filled.

SUMMARY OF THE INVENTION

These and other problems of the prior art are solved in accordance with the present invention by means of a plurality of pedestals for supporting containers to be filled with the product and a vibrator connected to the pedestals for imparting vibration to the containers as they are filled, thereby facilitating the settling of the product in the containers and substantially reducing products spilled. In accordance with one aspect of the invention, a tubular extension is provided in an area above each container to temporarily retain excess product while the product is settled in a container as the container is subjected to vibrations. In accordance with a particular aspect of the invention, a container chuck is provided engaging an upper end of the container and a lower end of the tubular extension to form an enclosed area between the extension and the container to avoid spillage in the filling process.

In accordance with another aspect of the invention, an outer cup is provided extending into an aligned opening in the product bowl and the outer cup section is vibrated to reduce bridging of the product along the product bowl openings, thereby enhancing the flow of product through the opening and into a corresponding volume-defining tubular section. In accordance with a specific aspect of the invention, vibrating rods extend between an aligned container chuck and the base of the outer cup section. When a container is disposed on one of the pedestals, the vibration imparted to the container is transmitted through the container chuck and the vibrating rods to the outer cup section, thereby causing vibration of both the container and the corresponding outer cup section.

Advantageously, the vibrating outer cup section assists in proper filling of the volume-defining tubular section for proper measurements of the volume to be deposited in a container and the tubular extension, in cooperation with the container chuck retains a portion of the product measured in the volume-defining tubular section while the product is settled in the container by operation of the vibrating pedestal. Various configurations of the outer cup are possible, offering various degrees of aggressiveness in assisting in the proper filling of the volume-defining tubular sections.

In accordance with one aspect of the invention, the vibrating pedestals are incorporated in a support plate which is rotated on a common shaft with the food bowl and intermediate support plates. Vibration is imparted to the pedestals from an annular ring, or the like, mounted on a stationary base and the vibrating pedestals are each provided with a roller engaging the stationary vibrating cam. In one specific embodiment of the invention, vibration is imparted to the vibrating cam by means of an electric motor provided with an offset pulley engaging the vibrator cam via a vibrator rod.

BRIEF DESCRIPTION OF THE DRAWINGS

The invention will now be described with reference to the drawings wherein.

DETAILED DESCRIPTION

Figure 1:
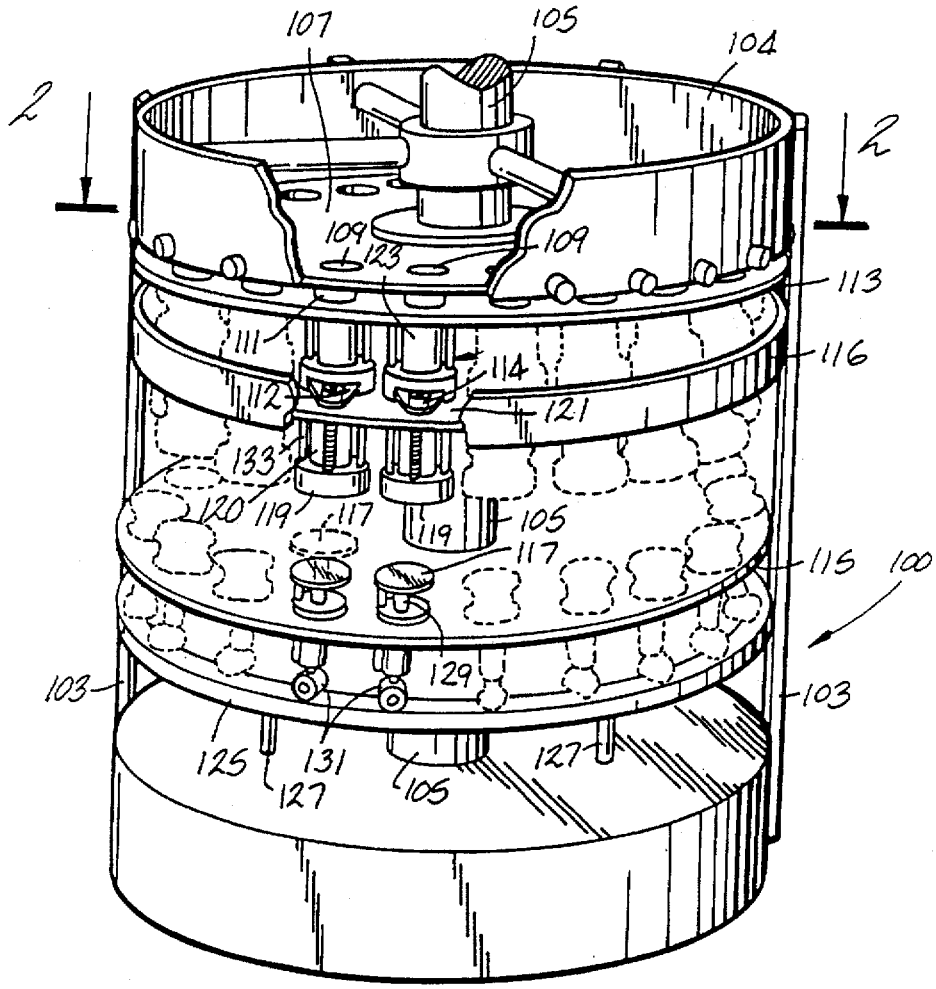
FIG. 1 is a prospective view of a volumetric container filling machine incorporating principles of the invention.

The volumetric filling apparatus 100 shown in FIG. 1, comprises a stationary base 101 and a plurality of support members 103 supporting an outer structure 104 and a shaft 105 supporting a carousel within the support structure. The carousel comprises a upper plate 107, also referred to as the product bowl, onto which product used to fill containers is deposited by means of a chute, or the like (not shown in the drawing). The upper plate 107 is provided with a plurality of openings 109 each communicating with a filler cup 111 comprising a vertically extending tubular section for retaining product to be deposited in a container. The filler cups 111 are supported on a support plate 113 mounted on the shaft 105. A container support plate 115 is provided with a plurality of container pedestals 117. The container pedestals 117 are provided to engage the bottom wall of a container to be filled. Container chucks 119 are suspended below a support plate 121 mounted on the shaft 105 and are provided to engage the upper portion of a container disposed on corresponding container pedestals. A plurality of volume-defining tubular sections 123 are mounted on the plate 121 in alignment with openings in the plate 121. Each tubular section 123 cooperates with a filler cup 111 to form a volumetric spatial area defining a volume of product to be deposited in a container. A sliding gate valve 112 form the lower wall of section 123. A roller 114 engages and cooperates with an outer rim 116, in a standard fashion, to open and close the sliding gate valve 112 at selected positions as the carousel revolves to allow product to pass from the cups 111 and tubular sections 123 into containers disposed between the pedestal 117 and the container chuck 119. Tubular extensions 120 extending below plate 121 define product collecting zones which retain products after the gate valve 112 has been opened and closed and before the product has settled in the container. A vibrating cam 125, vibrated by one or more vibrating linkages 127 is disposed below the pedestals 117 and engages support shafts 129 via rollers 131, imparting a vibration in the vertical direction to the pedestals 117. The cam 125 is preferably a non-rotating annular ring mounted on the base 101. When a container is disposed on the pedestal 117, the vibrating motion is transmitted to the container chuck 119 and via pushrods 133 to the filler cup 111. Empty containers such as the container 165 are typically transported to the carousel by means of a conveyor and moved from the conveyor onto the carousel by means of a well known star wheel or the like and the filled containers are similarly removed in a conventional manner.

Figure 2:
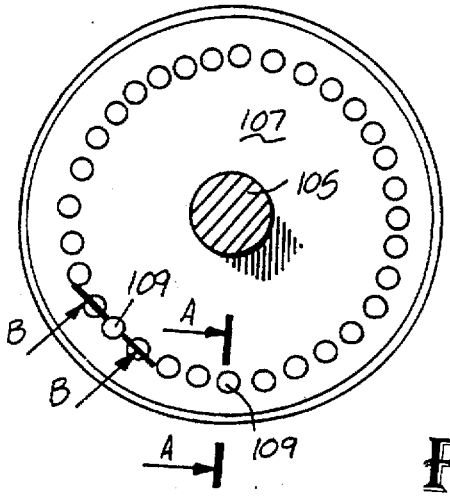
FIG. 2 is a top view of the filling machine showing product bowl with a plurality of openings.
Figure 3:
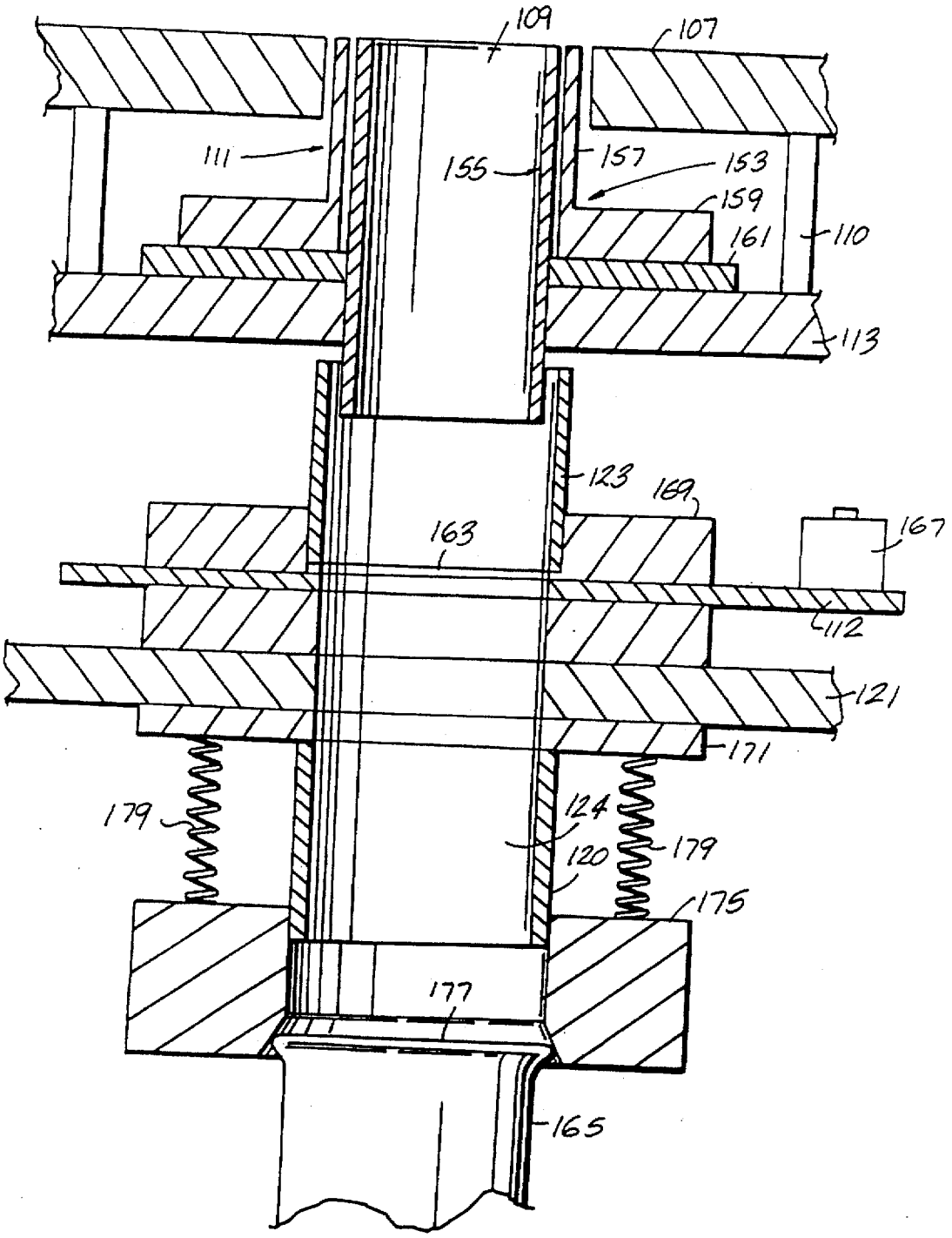
FIGS. 3 and 4 together form a cross-sectional view along lines A—A of FIG. 2.
Figure 4:
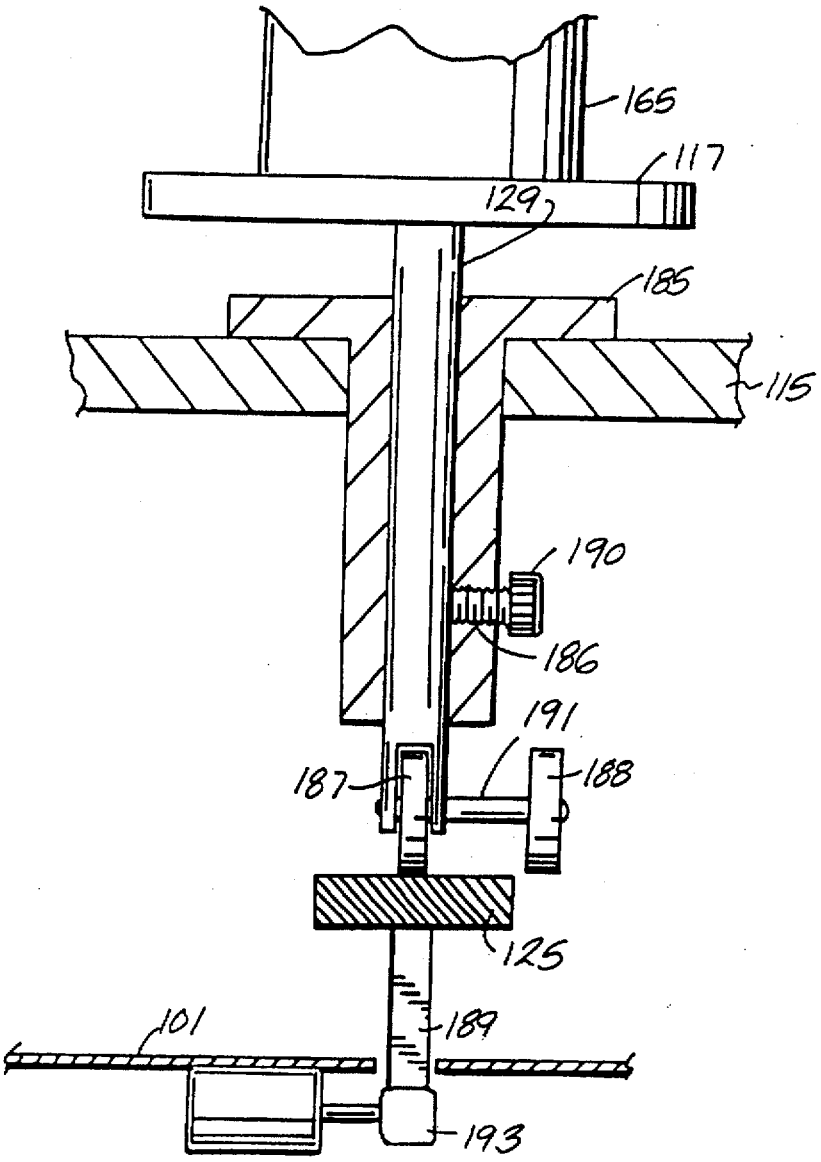

FIG. 2 is a top view of the filling machine. FIGS. 3 and 4 together form a cross-sectional view of the filling mechanism of the invention along a line A—A of FIG. 2. FIG. 3 shows the upper portion of the filling mechanism including the portion of the mechanism mounted on plates 107, 113 and 121 of FIG. 1. FIG. 4 shows the lower portion of the filling mechanism including the portion mounted on plate 115 of FIG. 1 as well as a portion of the vibrating cam 125 and the base 101 of FIG. 1. FIG. 3 shows the opening 109 of a filler cup 111 into which product is deposited by use of baffles or the like (not shown in drawing) on the plate 107 directing product into the opening 109. The filler cup 111 comprises a vibrating outer cup 153 and a stationary inner cup 155. As described further later herein with reference to FIGS. 5 and 6, the outer cup 153 is vibrated in the vertical direction relative to the vertically fixed product bowl, represented by plate 107, and the inner cup 155. The vibrating cup 153 comprises a vertical wall section 157 mounted on a horizontally disposed flange 159 movable in the vertical direction. Movement of the outer cup 153 aids the deposit of product in the inner cup and specifically reduces a bridging effect which tends to occur in a low density product, preventing a proper filling of the volumetric area 163 defined y the filler cup 111 and the tubular section 123 extending above sliding gate valve 112. A bushing 161 serves to retain the inner cup 155 in the plate 113 in a standard fashion.

Plate 121 mounts a sliding valve 112 intersecting the vertical spatial area defined by the tubular section 123 and forms the bottom wall of the volume-defining section defined by the inner cup 155 and section 123. In normal operation of a typical filler machine, the area above the sliding valve 163 is filled with product to be deposited in a container as the carousel is rotated. After a container 165 has been placed under the valve 112, the sliding valve is opened allowing the product to be moved through a collecting zone 124, defined by tubular extension 120, and into the container 165. The valve 112 is shown in the open position in FIG. 3. The valve 112 may be conventionally mounted on plate 121 by means of a conventional mounting structure such as structure 169 extending around the tubular section 123 and provided with a horizontal slotted opening in which the sliding valve 112 is disposed.

The upper portion of the tubular section 123 overlaps the inner cup 155 by a desirable overlap distance. The overlapping sections are used in conventional machines to allow for adjustment of the volume of product to be deposited in a container by changing the total distance between the upper rim of the inner cup 155 and the sliding valve 112. Such adjustment is accomplished in conventional machines by raising or lowering the plates 107 and 113, which are interconnected by posts 110, relative to the sliding gate 112.

Also shown is FIG. 3 is a can chuck 175 formed as an annular ring and extending around the tubular extension 120 and engaging an upper edge 177 of the container 165. As will be described further with reference to FIG. 4, the container is vibrated in the vertical direction to enhance proper settling of the product in the container and facilitating the movement of product from the collecting zone 124 defined by the tubular extension 120 into the container. The chuck is preferably made of a plastic material or other suitable material. The chuck 175 is suspended from the annular ring 171 by means of a pair of coil springs 179. The spacial area between the sliding gate 112 and the top edge of the container 165, forming the collection zone 124, is totally enclosed by the tubular extension 120 and the chuck 175 thereby avoiding spillage of product after the gate 112 has been opened and before the filled container is removed from the carousel.

FIG. 4 is a cross-sectional view of the lower part of the filling mechanism along the line A—A of FIG. 2. FIG. 4 depicts the container 165 resting on a pedestal 117. The pedestal 117 is provided with a vertical shaft 129 extending through an annular bushing 185 which is provided with a vertically-extending slotted opening 186. The vertical position of shaft 129 is adjustable in bushing 185 and the shaft is retained in position by adjustment screw 190. The pedestal 117 and the integral shaft 129 may be made of stainless steel or the like suitable material. The bushing 185 may be made of steel or some other suitable material. A pair of rollers 187, 188, interconnected by means of a shaft 191, are mounted on the lower end of shaft 129. Roller 187 supports the pedestal on the vibrating cam 125. Cam 125 is vibrated via a rigidly connected linkage 127 to a vibrating mechanism. The vibrating mechanism is preferably an electric motor mounted within the base 100 and provided with an irregularly-shaped pulley 193 which imparts a vertically-directed vibration to the cam 125 via the linkage 127. The vibration in cam 125 is transmitted via the wheel 187 and the shaft 129 of pedestal 117, thereby causing vertically-directed vibration of the container 165 which facilitates a settling of the product in the container 165. Roller 188 is used to slide up on or under a stationary cam (not shown in the drawing) to raise or lower the pedestal 117 when necessary for container transfer.

Figure 5:
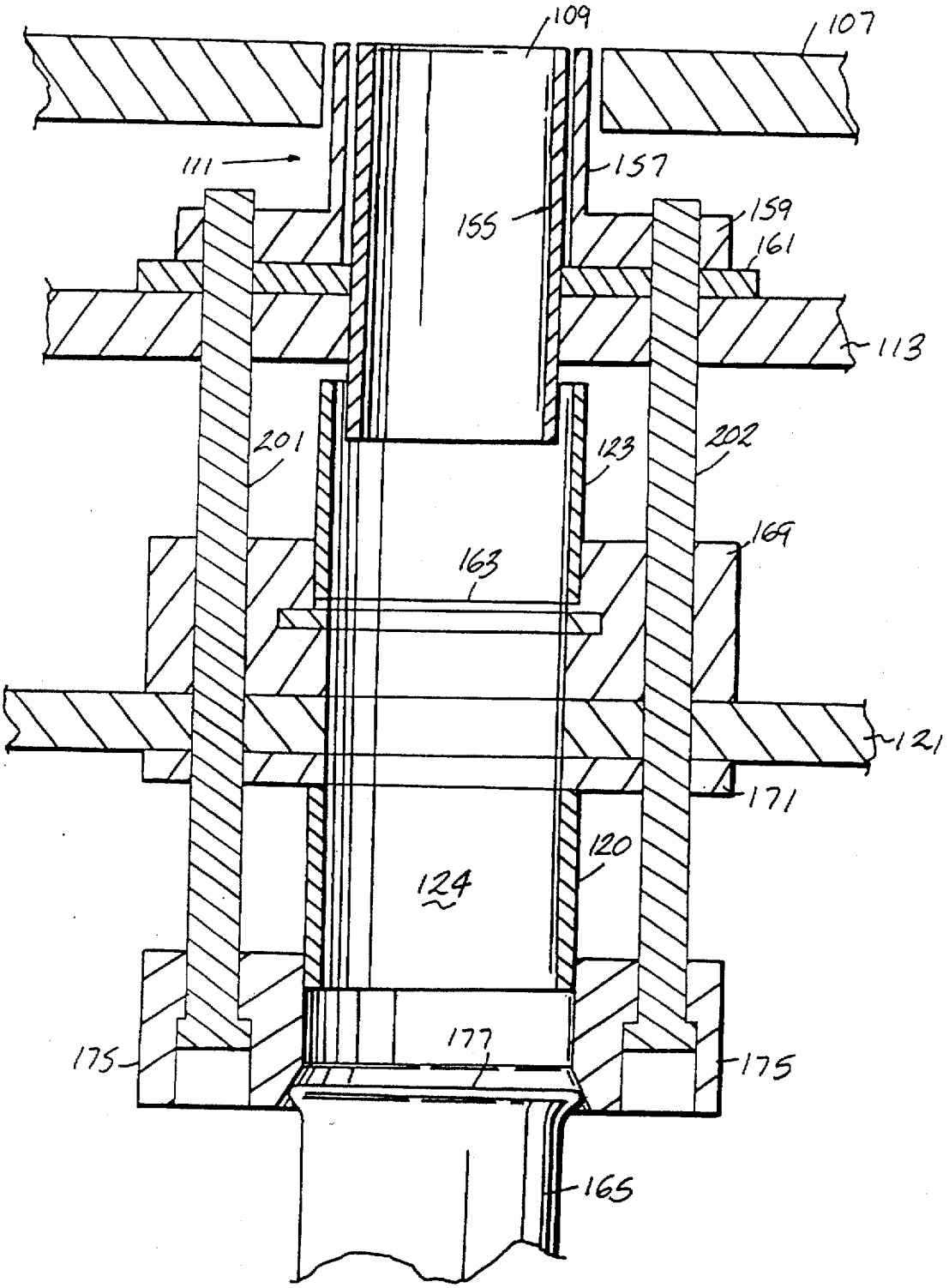
FIGS. 5 and 6 together form a cross-sectional view along lines B—B of FIG. 2.
Figure 6:
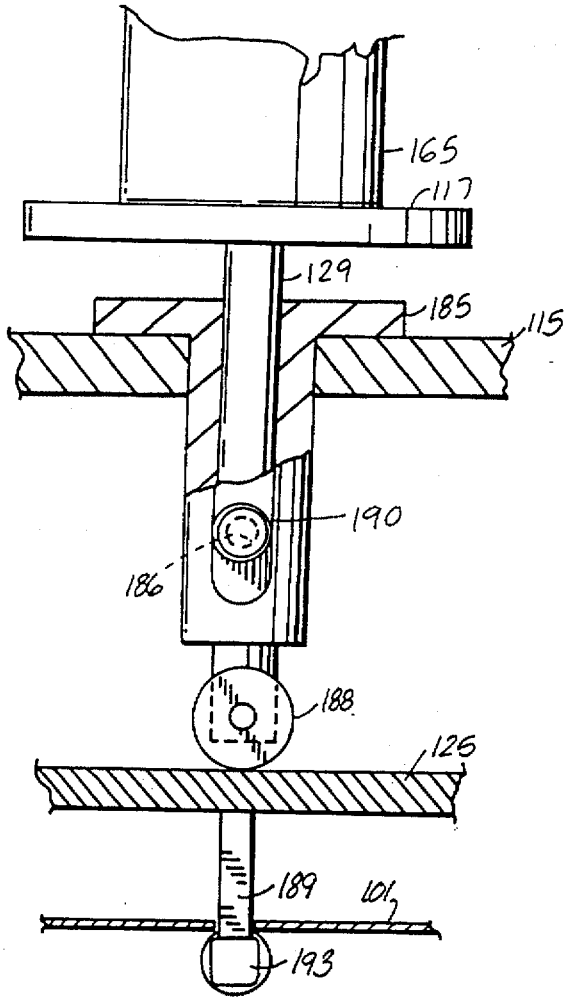

FIGS. 5 and 6 together represent a cross-sectional view of the filler mechanism along the line B—B. A pair of vertically-extending shafts 202 extend from the can chuck 175 through the annular ring 171, plate 121, mounting structure 169 and the annular ring 161 and have an upper end engaging the pedestal portion 159 of the outer cup 157. In this manner, the vibrating cam 125, which extends circularly with the carousel but does not rotate with the carousel, imparts vibration to the container 165 via the wheel 187 and shaft 129 of the container pedestal 117 to the container 165. The vertically-directed vibratory motion of container 165 is imparted to the container chuck 175 and, via rods 201 and 202, to the outer cup 153 via flange 159. In this manner, vibration of the outer cup is accomplished to avoid bridging during the filling of the spatial area 163 defined by the inner cup 155 and the tubular section 123 above the sliding gate 112. Simultaneously, vibration of the container 165 causes product deposited in the collection zone 124 as a result of the previous opening of the sliding gate 112 to settle in the container.

Figure 7:
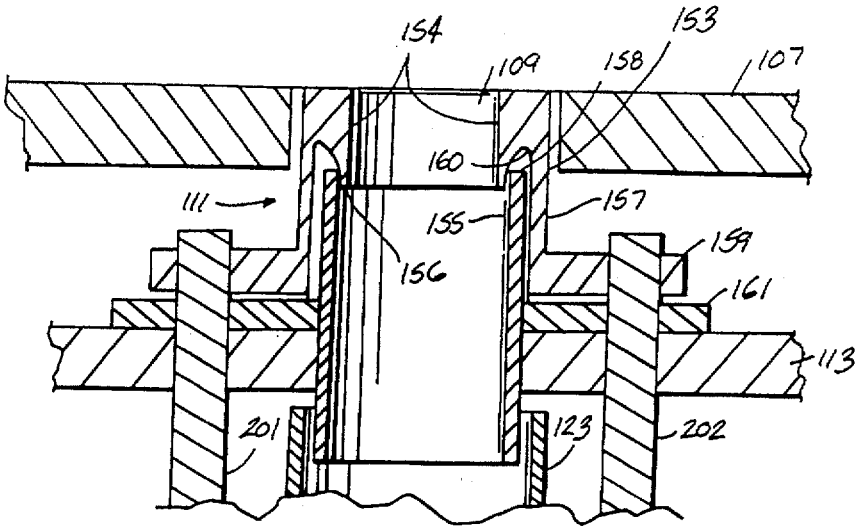
FIG. 7 is a partial breakaway view of an alternate embodiment of the outer cup of FIGS. 3 and 5.

FIG. 7 depicts an alternate embodiment of the vibrating cup 153 and the stationary inner cup 155. The length of the inner cup 155 is reduced such that the upper edge 158 of the cup 155 is below the upper surface of the plate 107. The vibrating cup 153 is provided with an expanded side wall section 154 in the portion of the vibrating cup between an upper area of the stationary inner cup 155 and the top surface of plate 107. The expanded side wall section 154 is provided with a downwardly-extending flange 156 extending over the upper rim 158 of the inner cup 155. The flange reduces bridging in the area of the upper edge of the stationary cup 155. A spacing of approximately one half inch between the upper rim 158 of the inner cup and an inner surface of the flange 156 is desirable to avoid contact between the vibrating outer cup 153 and the stationary inner cup 155.

It will be understood that the above described arrangement is merely illustrative of an application of principles of the invention and that other arrangements may be devised by those skilled in the art without departing from the scope of the invention as defined by the appended claims.

What we claim is:

1. Container filler apparatus comprising:

a rotatable central shaft extending in a vertical direction;

a first support plate for supporting product to be deposited in containers, the first support plate mounted on the shaft and extending in a horizontal direction and comprising a plurality of spaced apart openings;

a second support plate mounted on the shaft and extending in a horizontal direction and comprising a plurality of spaced apart pedestals for supporting containers to be filled with the product, each pedestal disposed in vertical alignment with one of the plurality of openings;

a vibrator connected to each of the pedestals for imparting vibration via the pedestals to containers supported on the pedestals;

a plurality of container chucks, each container chuck for engagement with a container disposed on one of the pedestals;

a plurality of outer cup devices each disposed in alignment with one of the openings and each engaging one of the container chucks for receiving vibrations from a container supported on one of the pedestals via the one of the container chucks to prevent bridging of product adjacent the one of the openings.

2. Container filler apparatus comprising:

a rotatable central shaft extending in a vertical direction;

a first support plate for supporting product to be deposited in containers, the first support plate mounted on the shaft and extending in a horizontal direction and comprising a plurality of spaced apart openings;

a second support plate mounted on the shaft and extending in a horizontal direction and comprising a plurality of spaced apart pedestals for supporting containers to be filled with the product, each pedestal disposed in vertical alignment with one of the plurality of openings;

a vibrator connected to each of the pedestals for imparting vibration via the pedestals to containers supported on the pedestals; and a third support plate disposed intermediate the first and second support plates and a plurality of outer cup devices disposed on the third support plate, each outer cup device comprising a wall extending into one of the plurality of openings, and a plurality of vibration transmission rods, at least one of the vibration transmission rods connected to one of the outer cup devices.

3. The apparatus in accordance with claim 2 and further comprising a plurality of container chucks, each container chuck for engaging a container disposed on one of the pedestals, and wherein each of the vibration rods engages one of the container chucks, whereby vibration is transmitted from the pedestals via containers disposed on the pedestals and the pedestal chucks and the vibration rods to the outer cups.

4. The apparatus in accordance with claim 3 and further comprising a fourth support plate having a lower surface and disposed intermediate the second and third support plates and wherein the container chucks are suspended from the lower surface of the fourth support plate.

5. The apparatus in accordance with claim 4 and further comprising a plurality of coil springs each having one end attached to the lower surface and wherein the container chucks are suspended from the lower surface of the third support plate by the coil springs.

6. The apparatus in accordance with claim 2 and further comprising a plurality of inner cups, each inner cup disposed internal to one of the outer cup devices, the inner cups fixedly mounted on the third support plate.

7. The apparatus in accordance with claim 6 and further comprising a fourth support plate disposed intermediate the second and third support plates and having an upper surface and a lower surface and further comprising a plurality of container chucks suspended from the lower surface, each container chuck for engaging a container disposed on a pedestal, the fourth plate further comprising a plurality of openings in alignment with the openings in the first support plate and a plurality of tubular sections, each tubular section disposed on the upper surface and in alignment with one of the openings in the fourth support plate, and a sliding gate in each of the tubular sections.

8. The apparatus in accordance with claim 7 and further comprising a plurality of tubular extensions disposed below the lower surface of the fourth support plate, each tubular extension disposed in alignment with one of the tubular sections.

9. The apparatus in accordance with claim 2 and further comprising an inner cup having an inner wall disposed within each of the outer cup devices, each inner wall having an upper edge, and wherein the wall of each outer cup device comprises an enlarged upper flange area extending over the upper edge of the inner wall of an inner cup, whereby bridging in the inner cup is reduced.

10. Container filler apparatus comprising:

a rotatable central shaft extending in a vertical direction;

a first support plate for supporting product to be deposited in containers, the first support plate mounted on the shaft and extending in a horizontal direction and comprising a plurality of spaced apart openings;

a second support plate mounted on the shaft and extending in a horizontal direction and comprising a plurality of spaced apart pedestals for supporting containers to be filled with the product, each pedestal disposed in vertical alignment with one of the plurality of openings;

a vibrator connected to each of the pedestals for imparting vibration via the pedestals to containers supported on the pedestals; and a vibrating cam disposed below the second support plate and wherein each pedestal comprises a vertically-extending shaft having one end engaging the vibrating cam.

11. The apparatus in accordance with claim 10 and further comprising an electric motor connected to the vibrating cam for imparting vibration to the vibrating cam in the vertical direction.

12. The apparatus in accordance with claim 11 and further comprising an irregularly-shaped pulley and wherein the electric motor comprises a shaft engaging the pulley and the vibrating cam.

13. The apparatus in accordance with claim 10 and further comprising a fixed base and wherein the central shaft and the first and second support plates are rotatable with respect to the fixed base and the vibrating cam is mounted on the fixed base.

14. The apparatus in accordance with claim 13 wherein the vibrating cam comprises an annular ring and wherein the one end of the vertically-extending shaft of each pedestal comprises at least one wheel supported on the vibrating cam.

15. Container filler apparatus comprising:

a rotatable central shaft extending in a vertical direction;

a first support plate for supporting product to be deposited in containers, the first support plate mounted on the shaft and extending in a horizontal direction and comprising a plurality of spaced apart openings;

a second support plate mounted on the shaft and extending in a horizontal direction and comprising a plurality of spaced apart pedestals for supporting containers to be filled with the product, each pedestal disposed in vertical alignment with one of the plurality of openings;

a vibrator connected to each of the pedestals for imparting vibration via the pedestals to containers supported on the pedestals;

a plurality of container chucks, each container chuck for engagement with a container disposed on one of the pedestals; and a third support plate disposed between the first and second support plates, the third support plate comprising a plurality of openings disposed in alignment with openings in the first support plate and a plurality of tubular extensions extending below the third support plate, each tubular extension disposed in alignment with one of the openings in the upper plate and having a lower edge disposed adjacent a container chuck, thereby forming an enclosed area immediately adjacent a container supported on one of the pedestals.

16. The apparatus in accordance with claim 15 and further comprising a plurality of volume-defining tubular sections supported on the third support plate and disposed in alignment with the openings in the third plate, and wherein the tubular extensions have upper openings communicating with the volume-defining tubular sections.

* * * * *